US006247414B1

(12) United States Patent
Sikora et al.

(10) Patent No.: US 6,247,414 B1
(45) **Date of Patent: *Jun. 19, 2001**

(54) CONSTRUCTION SYSTEM FOR BUILDING THREE-DIMENSIONAL STRUCTURES

(75) Inventors: Günther Sikora; Gerhard Sikora, both of Steyr (AT)

(73) Assignee: Gunther Sikora, Steyr ( * ) Notice: Subject to any disclaimer, the term of this patent is extended or adjusted under 35 U.S.C. 154(b) by 0 days.

This patent is subject to a terminal disclaimer.

(21) Appl. No.: 09/539,391

(22) Filed: Mar. 31, 2000

Related U.S. Application Data

(63) Continuation of application No. 09/091,284, filed as application No. PCT/AT96/00220 on Nov. 14, 1996, now Pat. No. 6,062,150.

(51) Int. Cl.[7] ..... A47B 91/00

(52) U.S. Cl. ..... 108/190; 108/147.13

(58) Field of Search ..... 108/180, 190, 108/153.1, 159, 158.12, 147.11, 147.12, 147.13, 147.14, 147.15, 192, 91; 211/126.2, 133.1, 186, 187, 188; 248/188, 235

(56) References Cited

U.S. PATENT DOCUMENTS

| | | | | |
|---|---|---|---|---|
| 3,730,601 | * | 5/1973 | Misenheimer, III | 108/190 X |
| 3,783,801 | * | 1/1974 | Engman | 108/190 X |
| 4,128,064 | * | 12/1978 | Chung et al. | 108/147.13 X |
| 4,145,977 | * | 3/1979 | Yellin | 108/190 |
| 4,275,666 | * | 6/1981 | Schriever | 108/190 X |
| 4,474,416 | * | 10/1984 | Rogahn | 108/192 X |
| 4,852,501 | * | 8/1989 | Olson et al. | 108/190 |
| 5,676,263 | * | 10/1997 | Chang | 108/180 X |
| 5,881,653 | * | 3/1999 | Pfister | 108/192 X |
| 6,062,150 | * | 5/2000 | Sikora et al. | 108/190 |

FOREIGN PATENT DOCUMENTS

| | | | |
|---|---|---|---|
| 215331 A1 | 9/1979 | (AR) | A47B/87/100 |

* cited by examiner

*Primary Examiner*—Jose V. Chen
(74) *Attorney, Agent, or Firm*—Lorusso & Loud

(57) ABSTRACT

A construction system for the rapid assembly of three-dimensional structures, especially shelves, having preferably vertical supports to which structural components, particularly shelves, are releasably attachable, in which the supports pass through drillings or recesses in the structural components. The supports, which comprise spacer sleeves inserted over bar members, are removably connected to the structural components through the use of connecting inserts, which are arranged within a drilling or recess in a structural component secured to the latter via the supports. The spacer sleeves are supported at the connecting inserts, which provides added stability to the structure when assembled.

30 Claims, 26 Drawing Sheets

CONSTRUCTION SYSTEM FOR BUILDING THREE-DIMENSIONAL STRUCTURES

CROSS-REFERENCE TO RELATED APPLICATIONS

Figure 1:
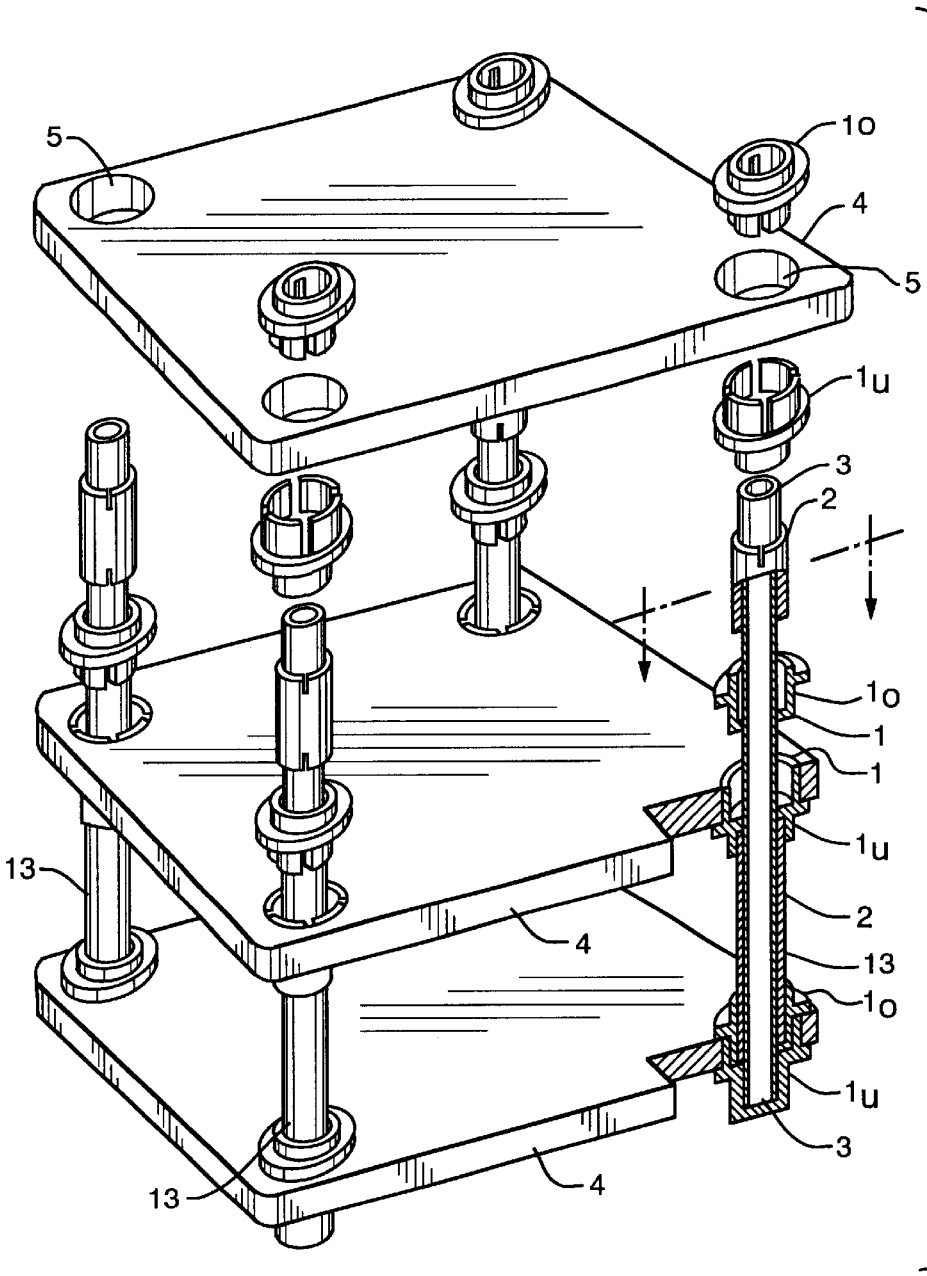

This application is filed under 37 C.F.R. 1.53 (b) and is a continuation of application Ser. No. 09/091,284, filed Jun 15, 1998, now U.S. Pat. No. 6,062,150 which is a National Stage Application of PCT/AT96/00220 filed Nov. 14,1996, which corresponds to Austria Application A 2095/95 filed Dec. 22, 1995, the contents of which are incorporated herein by reference.

A claim of priority is made to U.S. National Stage application Ser. No. 09/091,284, filed Jun. 15, 1998, which claims priority to PCT/AT96/00220 filed Nov. 14, 1996, which claims priority to Austria Application A 20951/95 filed Dec. 22, 1995, the contents of which are incorporated herein by reference.

A true and accurate copy of the U.S. National Stage application Ser. No. 09/091,284 as originally filed is supplied below, including the Specification, claims, drawings, and oath or declaration of the inventor showing his signature. No amendments referred to in the oath or declaration filed to complete the U.S. National Stage Application introduced new matter.

The invention concerns a construction system for building three-dimensional structures, in particular shelves with preferably vertical supports to which construction members, in particular panels, can be releasably fixed, wherein the supports extend through bores or openings in the construction members, and wherein there are provided connecting inserts which can each be arranged in the region of a bore or opening in a construction member and by way of which the supports can be connected to the construction members.

Such construction systems can be used in particular for building shelves, wherein there are then provided generally vertical supports and the construction members are in the form of horizontal plates or panels. Other uses however are also certainly conceivable and possible, for example framework structures, exhibitions stands, toys and play items and other three-dimensional structures can be constructed therewith. The connection of the supports which extend through bores or openings in the construction members, to the construction members, is not effected directly but by way of special connecting inserts. Such connecting inserts which are known from EP-A1-0 195 527 make it possible to form a stable connection between the supports and the construction members, even when the construction members are of comparatively small thickness.

The object of the invention is to provide a flexible stable construction system which can be rapidly built, for building three-dimensional structures.

In accordance with the invention that is achieved in that the supports—as is known per se—comprise bars and spacer sleeves which an be pushed thereon, wherein the bars extend through the connecting inserts and the spacer sleeves are arranged between the construction embers and are supported at the connecting inserts.

Supports comprising bars and spacer sleeves are already known from B-A-13 19 737. What is novel however is the idea that the spacer sleeves are supported at the connecting inserts, which permits a stable connection.

Figure 2:
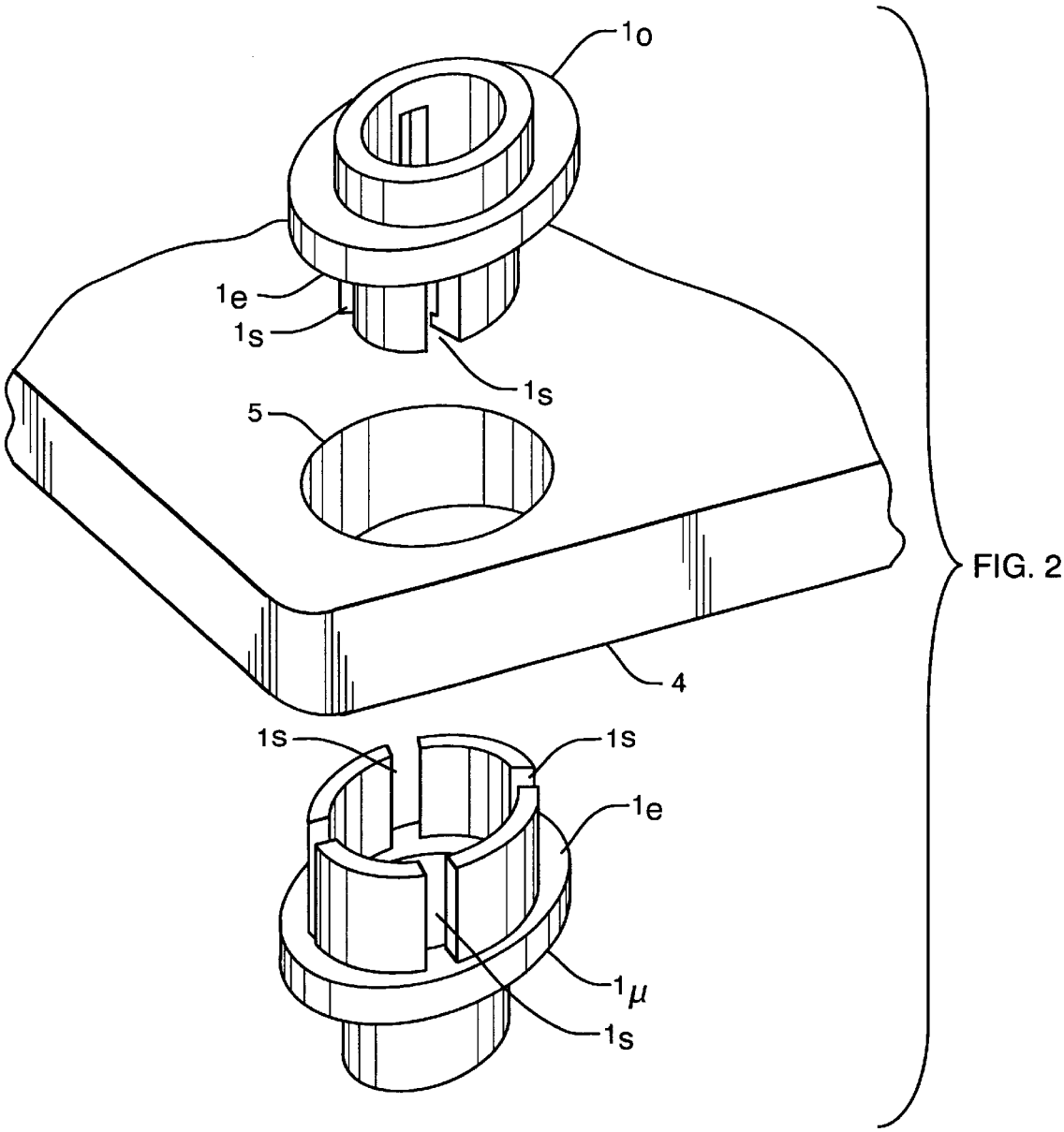
Figure 3:
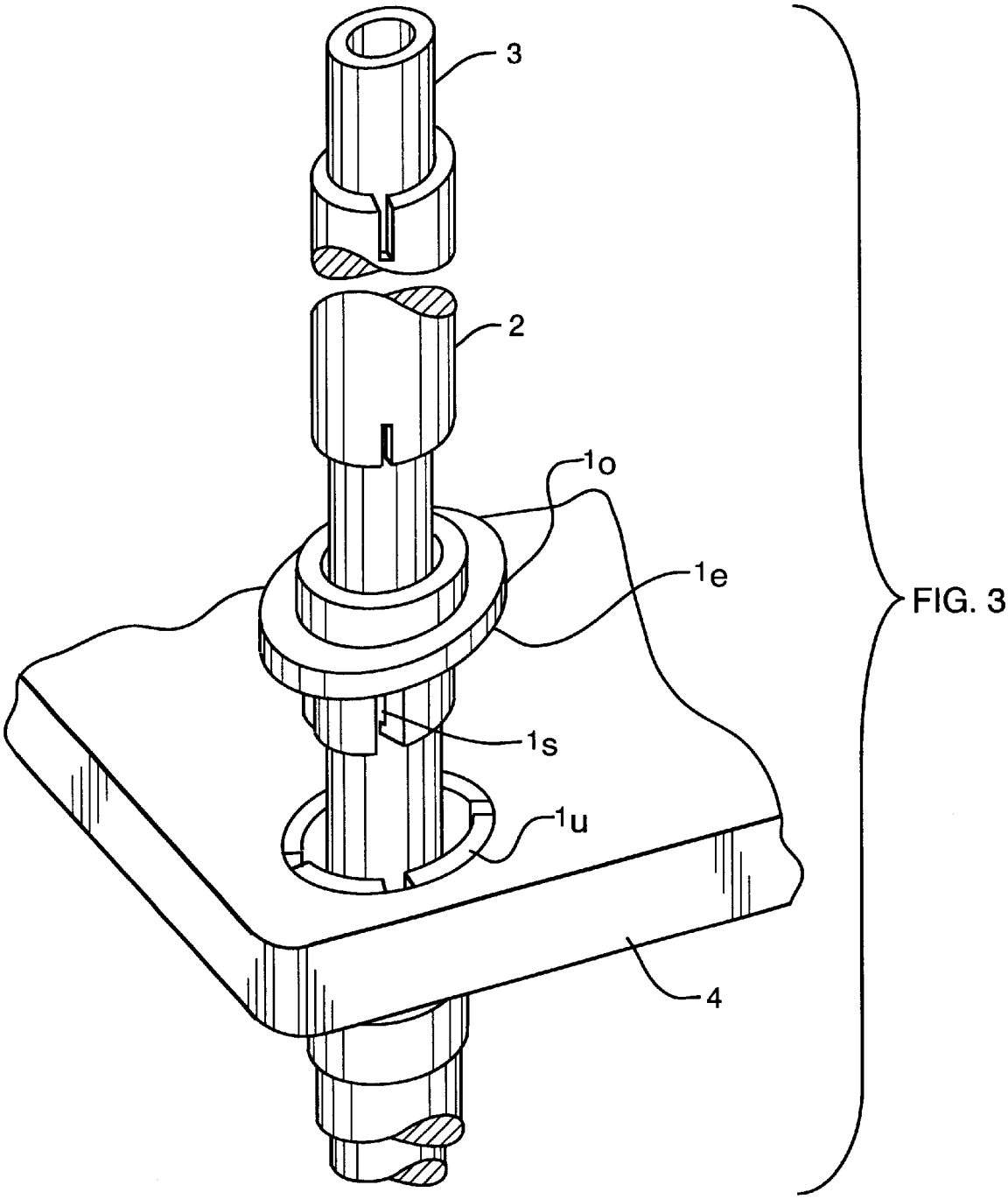
Figure 4:
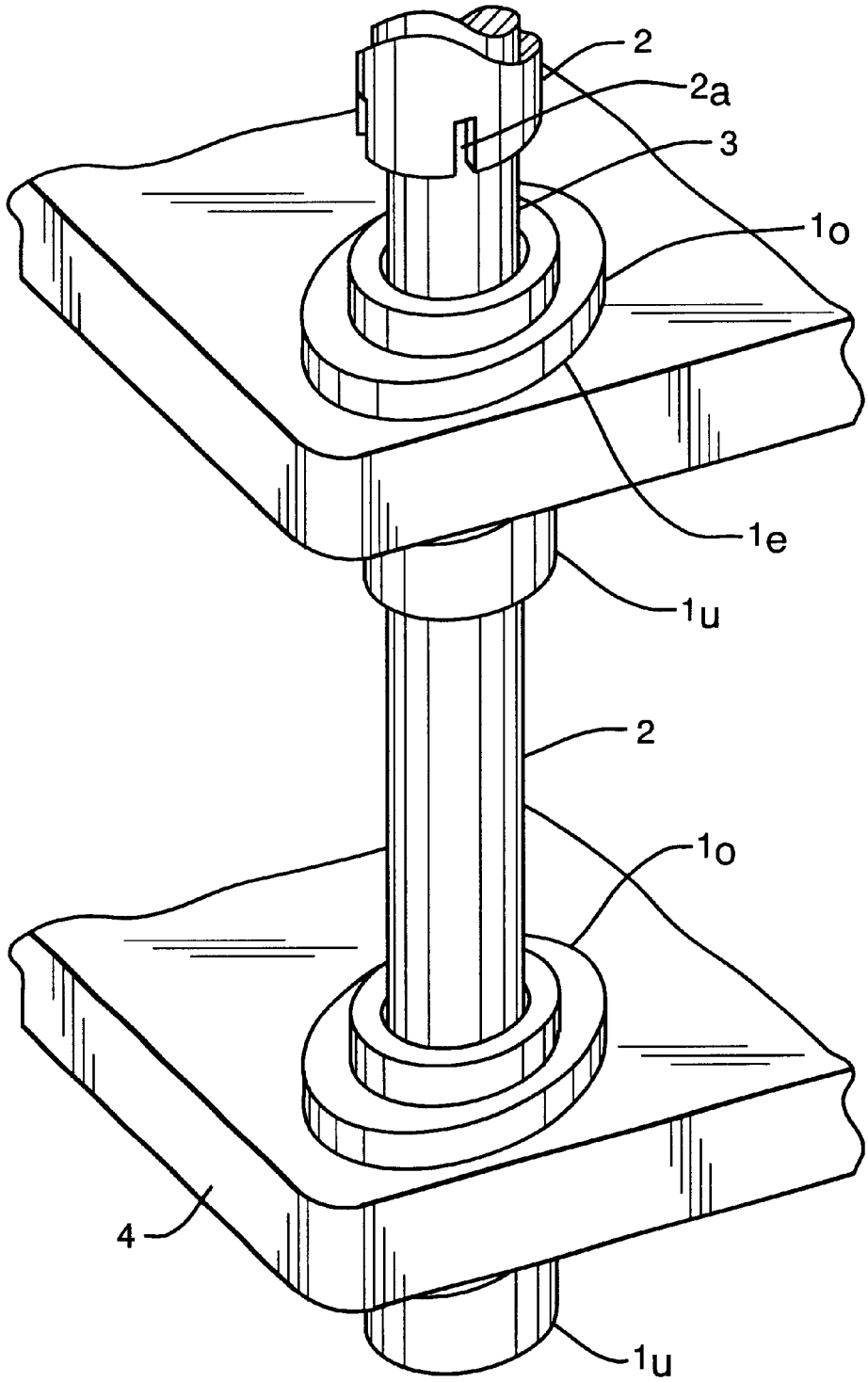
Figure 5:
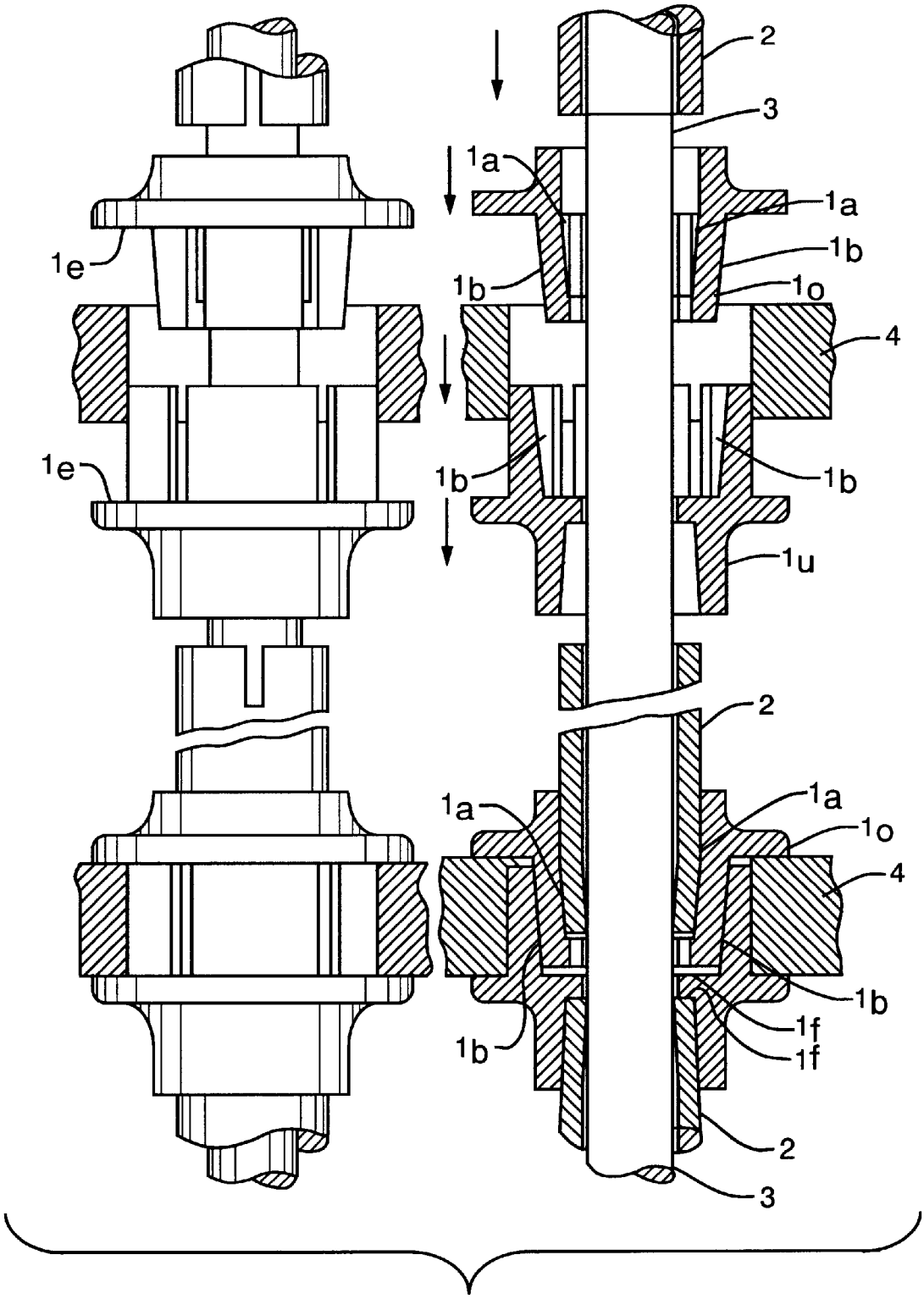
Figure 6:
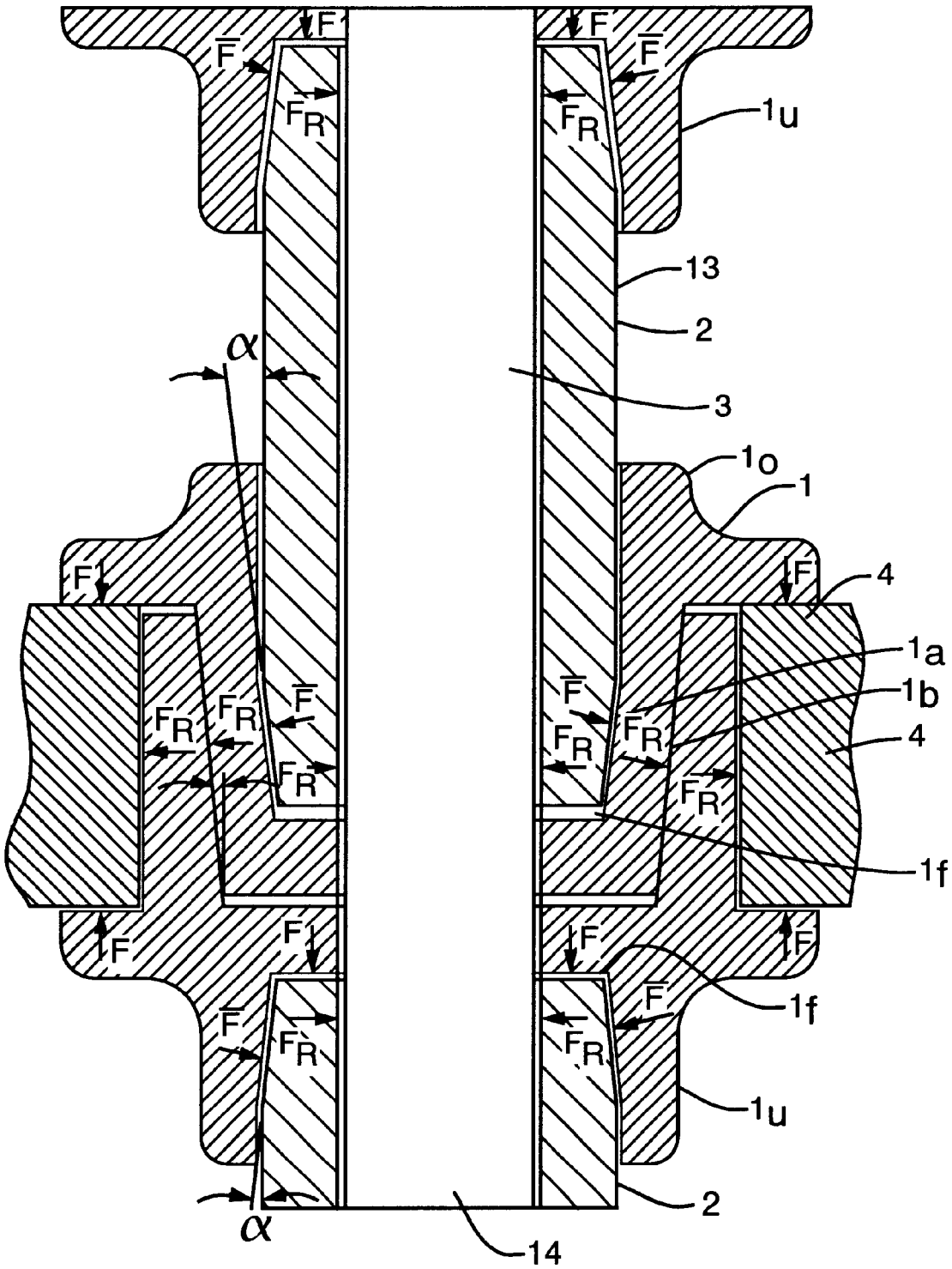
Figure 7:
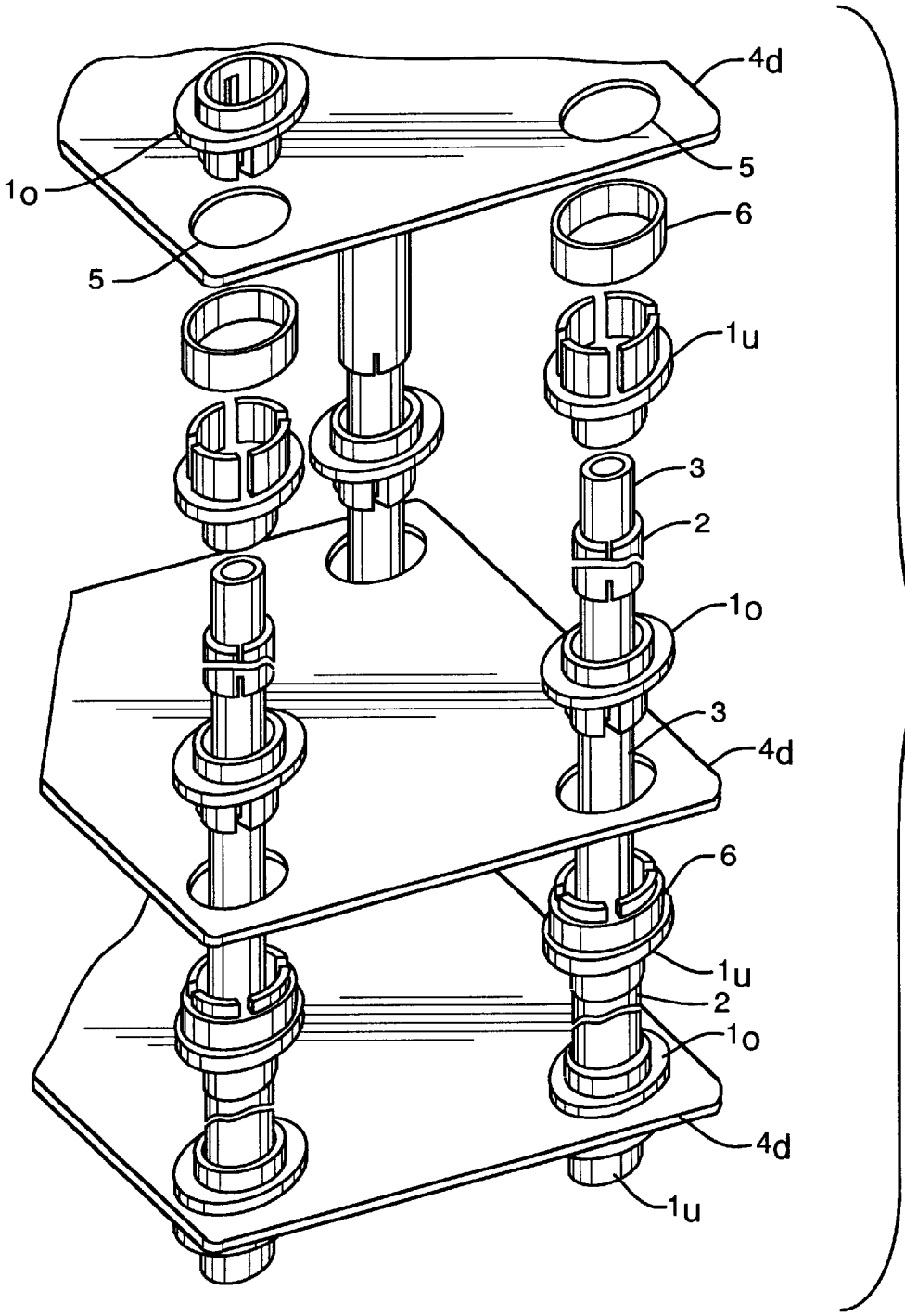
Figure 8A:
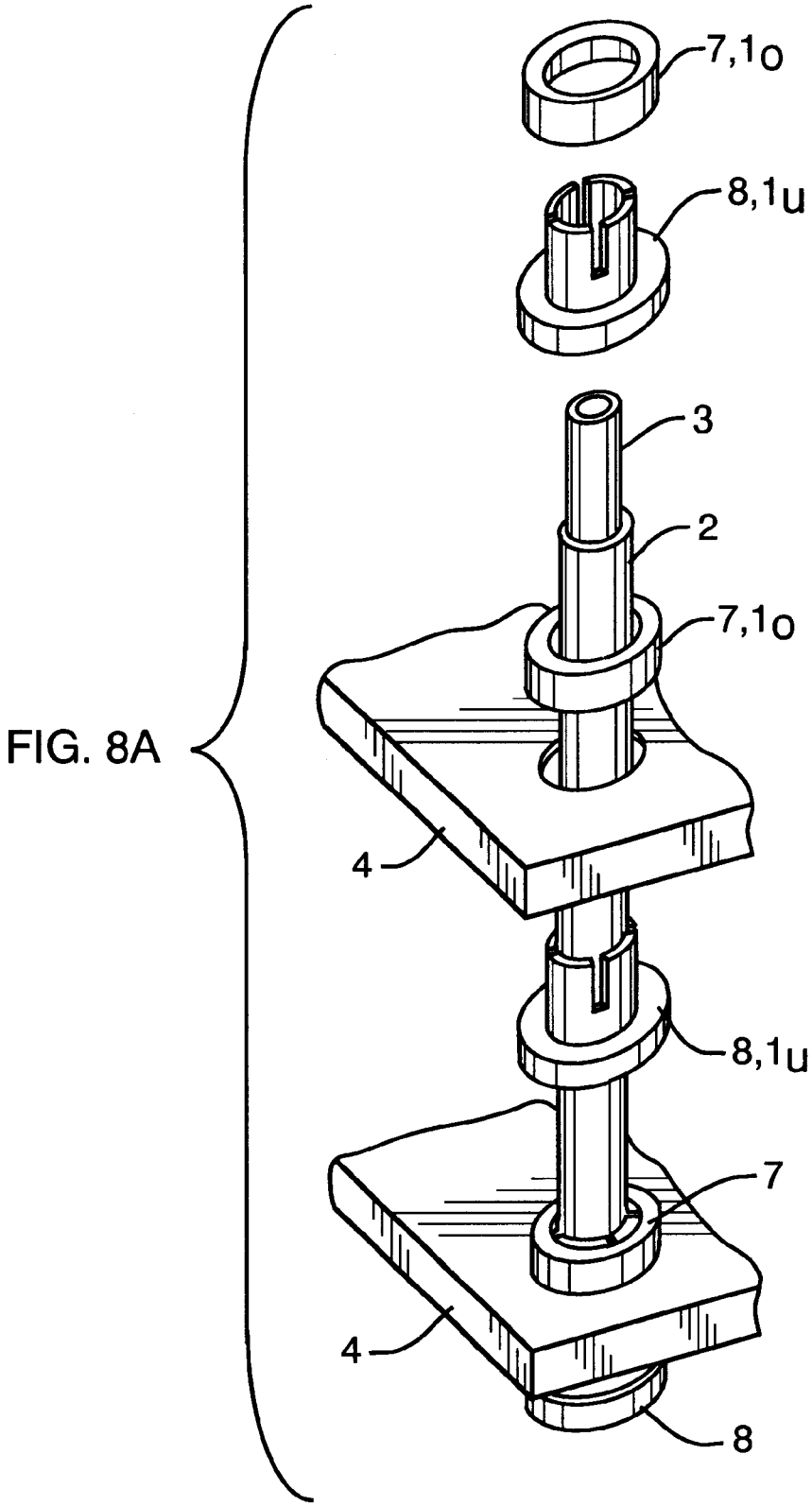
Figure 8B:
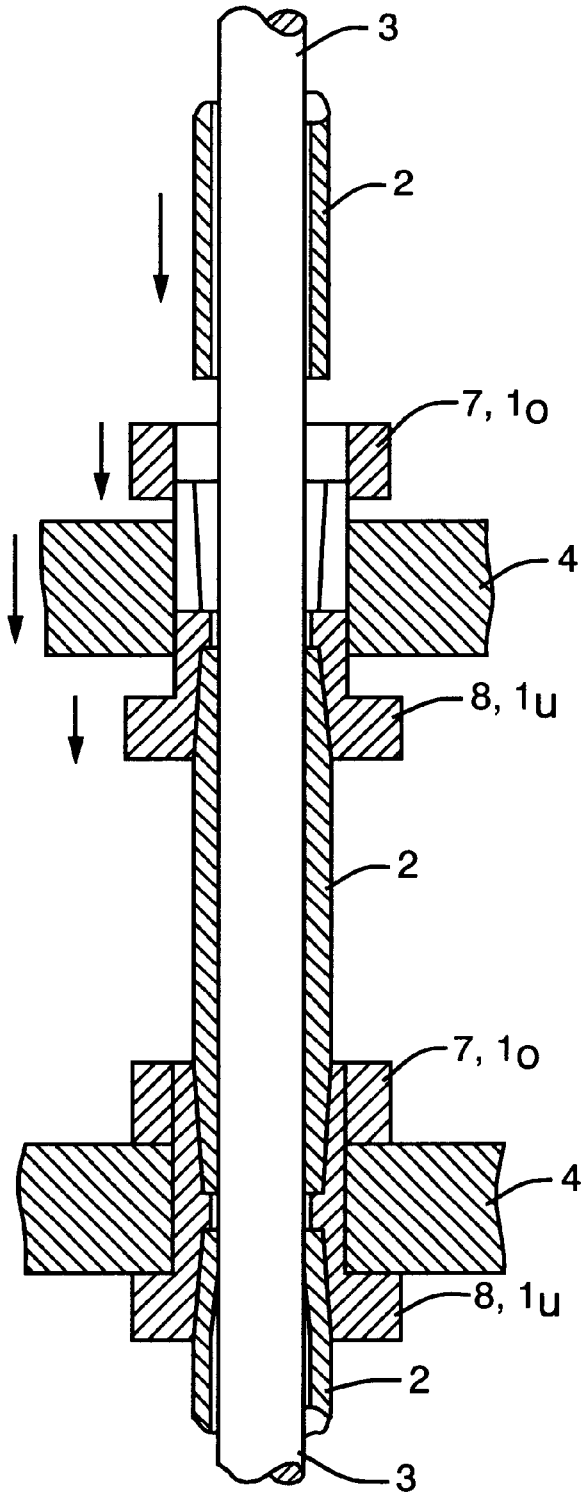
Figure 9A:
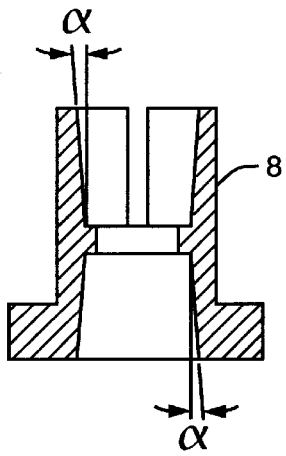
Figure 9B:
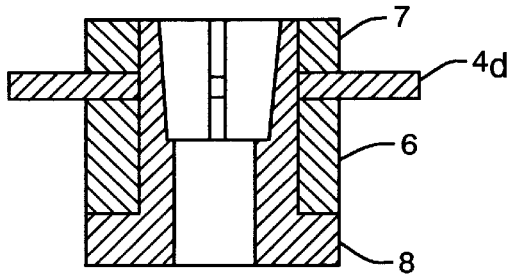
Figure 9C:
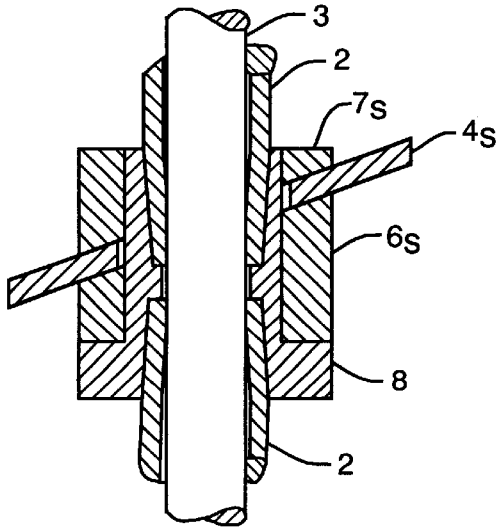
Figure 10:
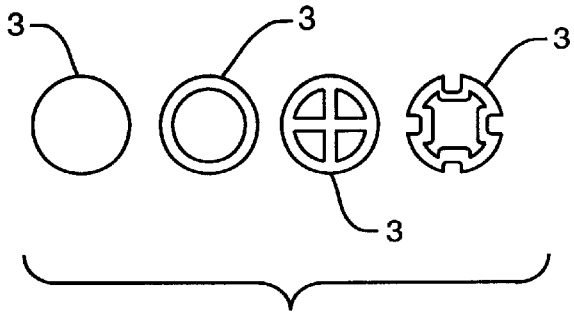
Figure 11A:
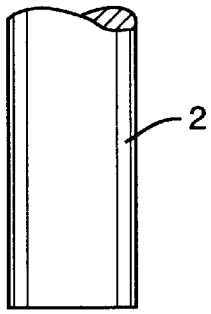
Figure 11B:
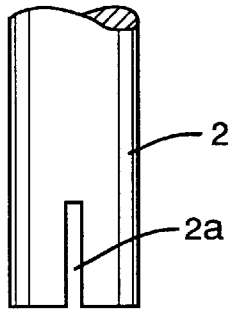
Figure 11C:
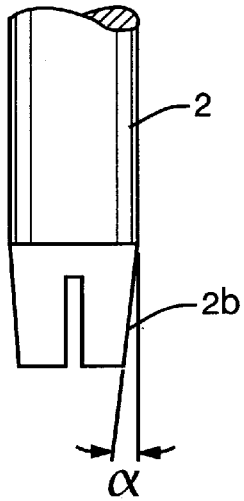
Figure 12:
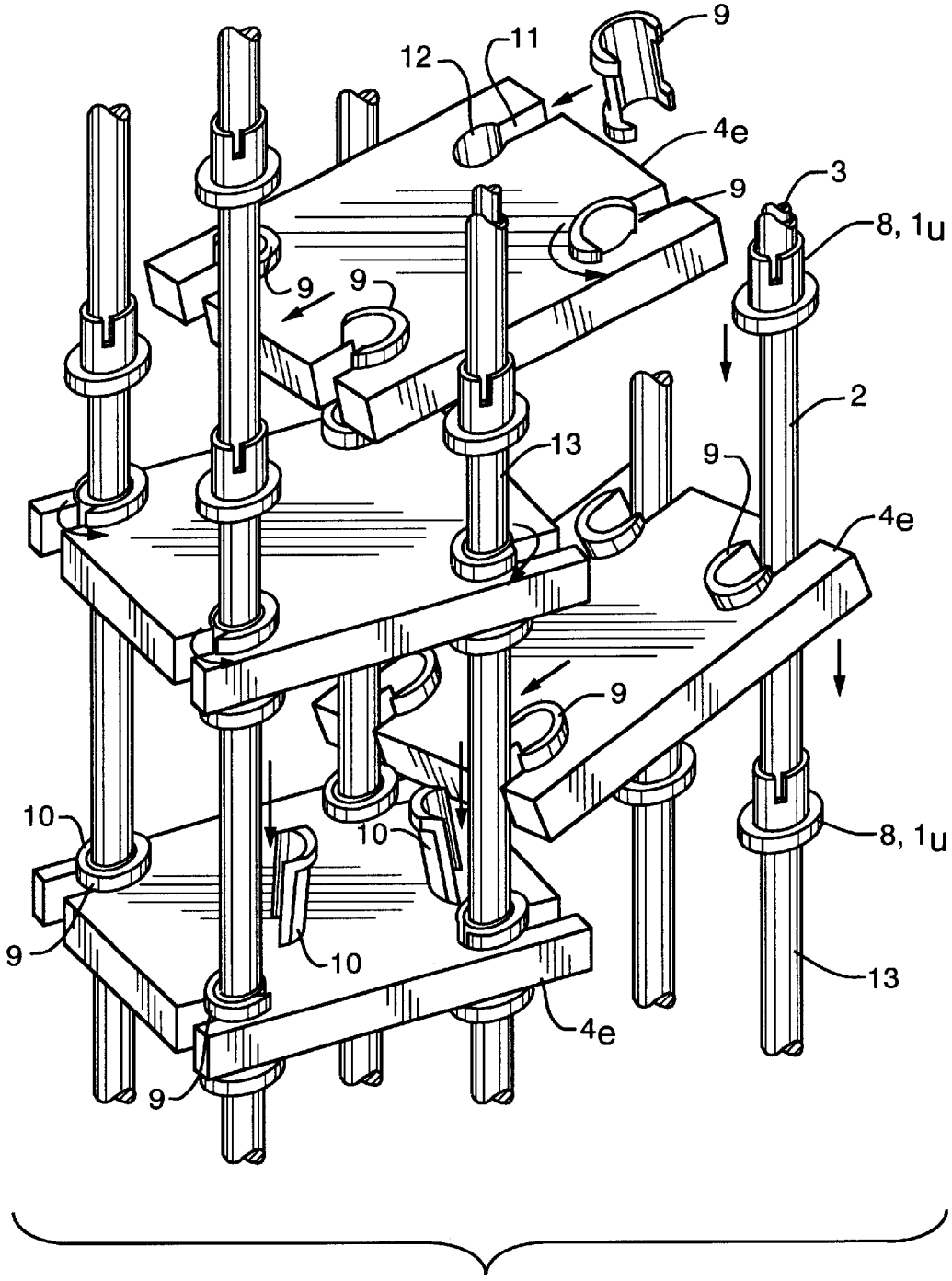
Figure 13:
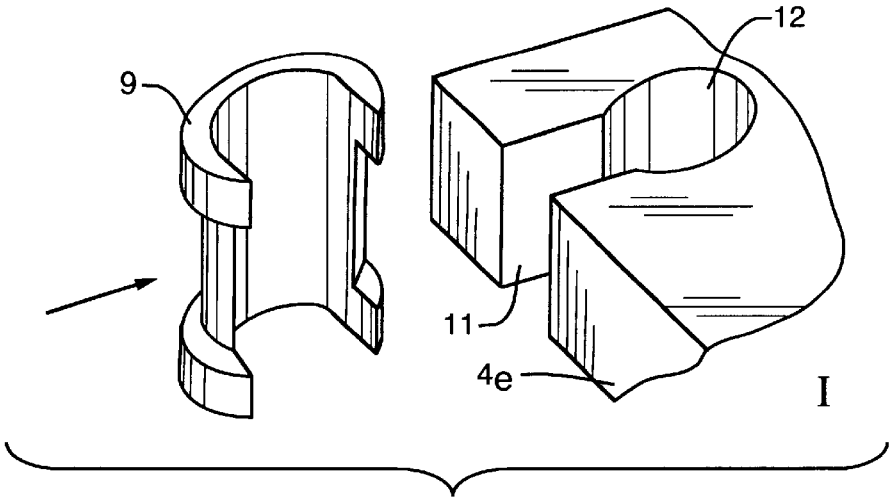
Figure 14:
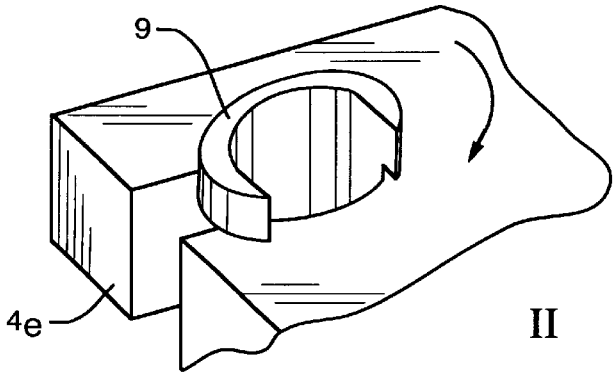
Figure 15:
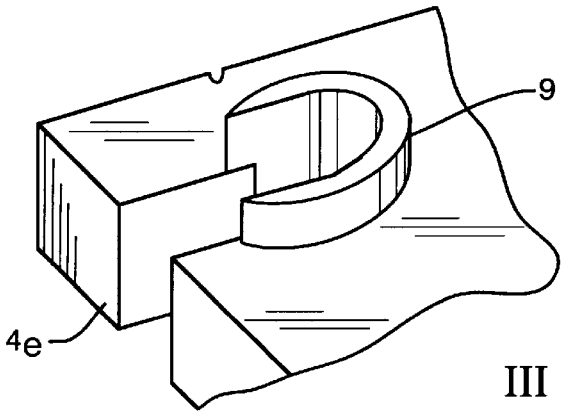
Figure 18:
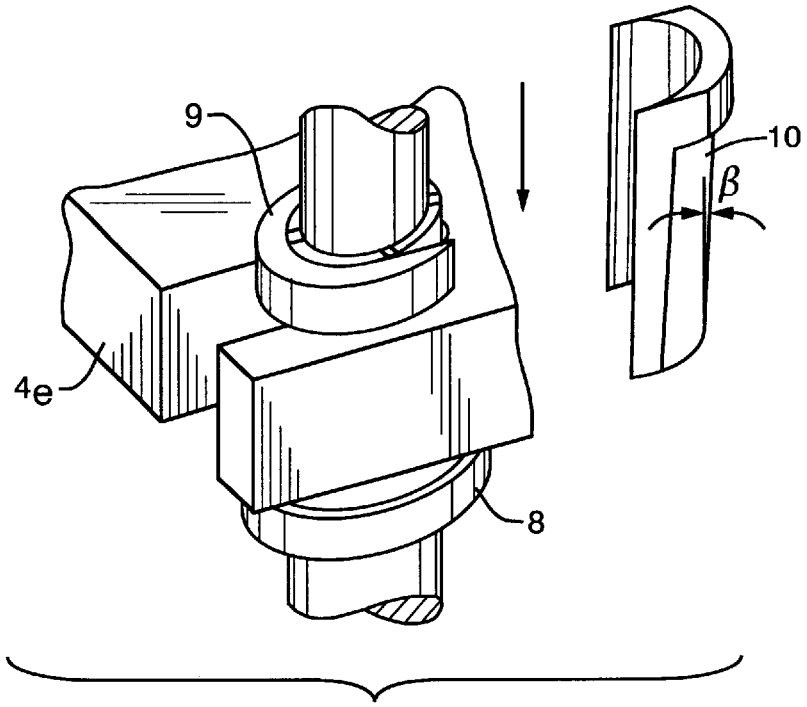
Figure 19:
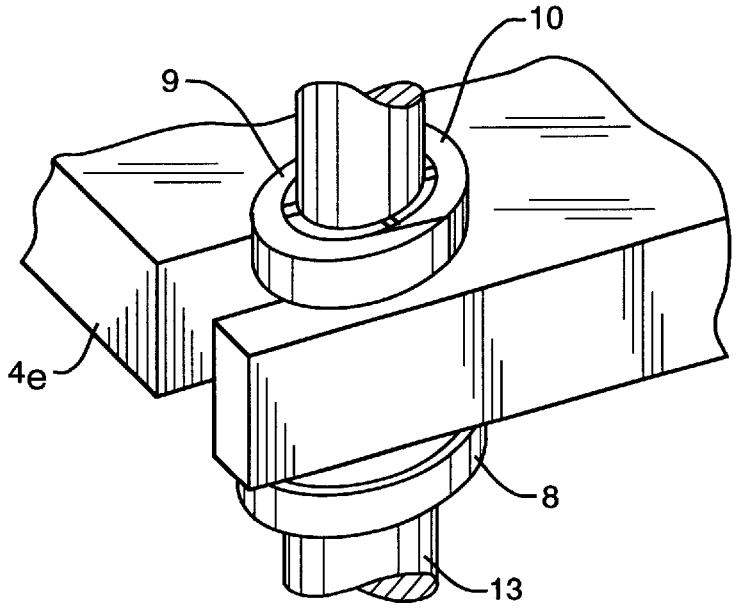
Figure 20A:
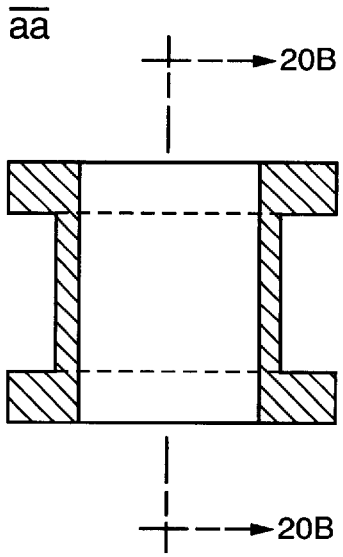
Figure 20B:
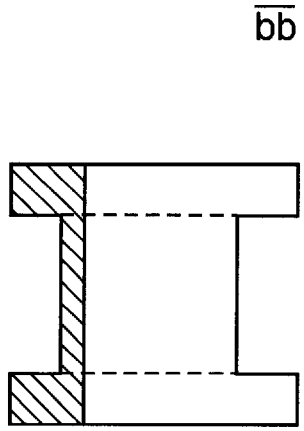
Figure 20C:
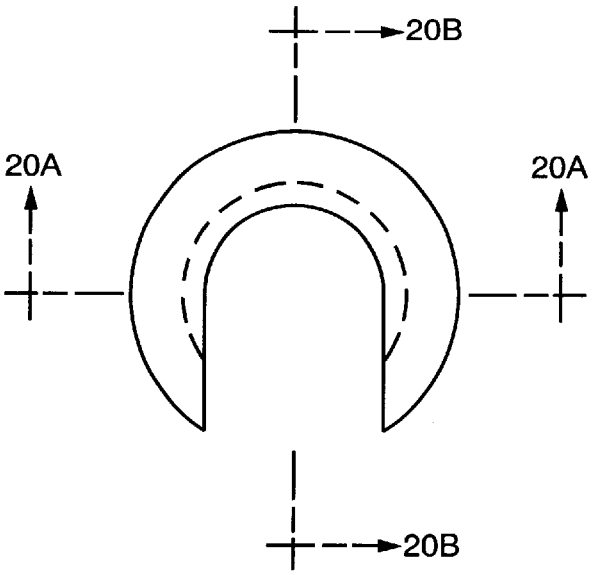
Figure 21A:
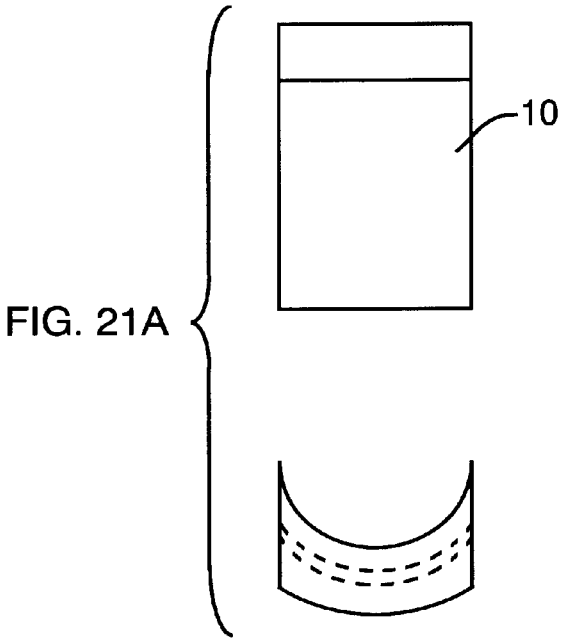
Figure 21B:
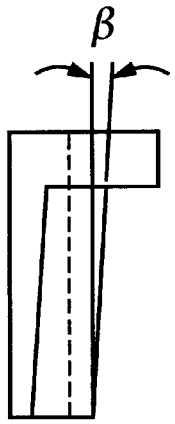
Figure 22A:
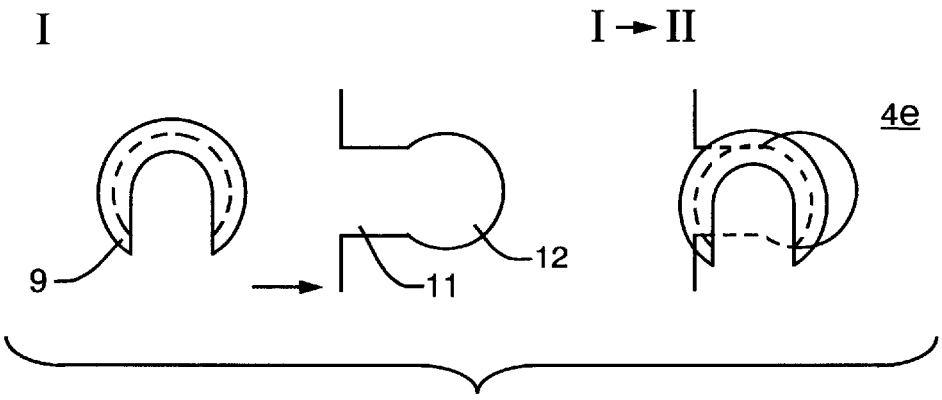
Figure 22B:
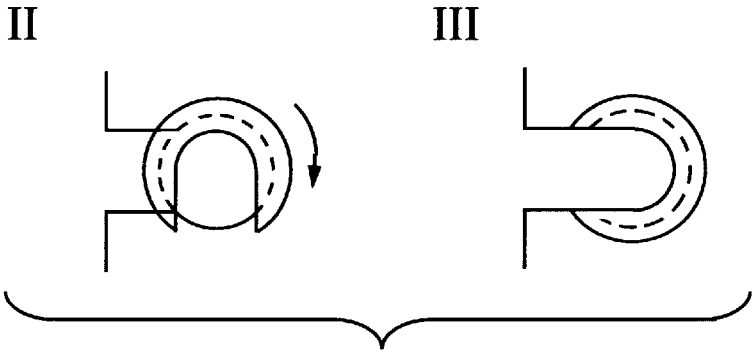
Figure 22C:
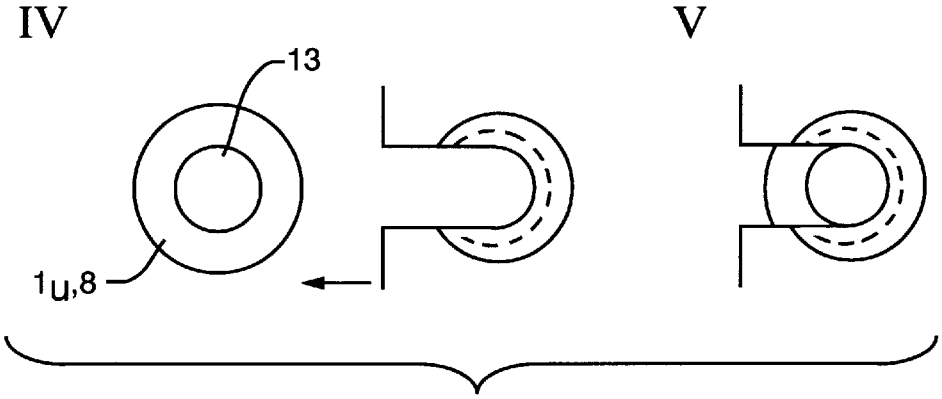
Figure 22D:
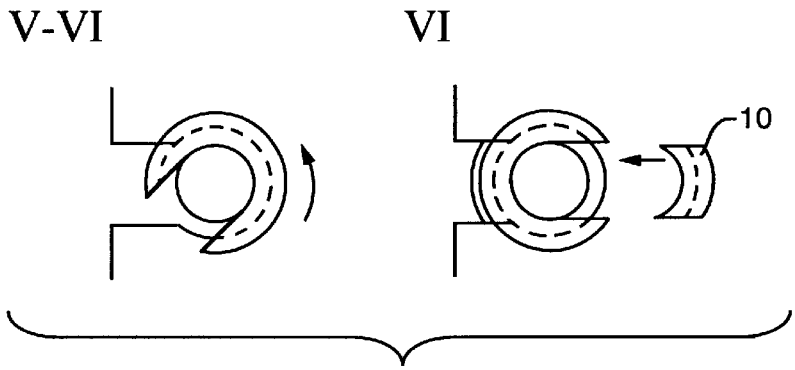
Figure 22E:
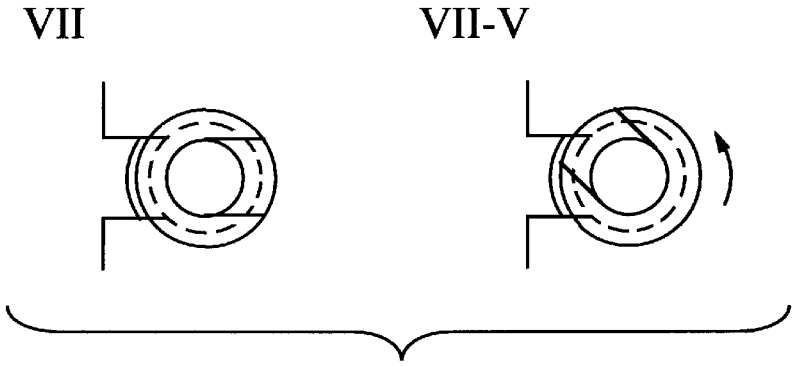
Figure 22F:
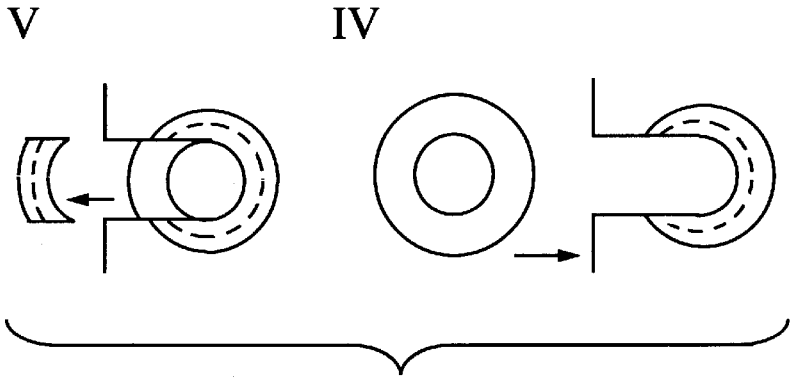
Figure 23A:
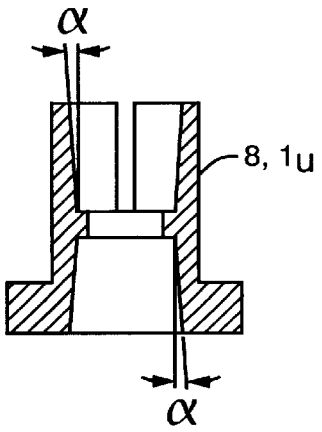
Figure 23B:
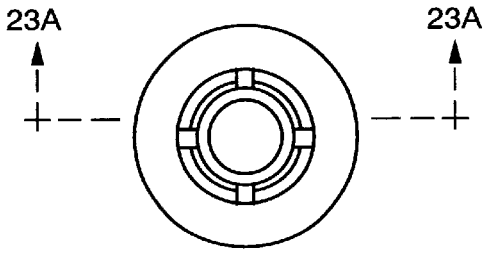
Figure 23C:
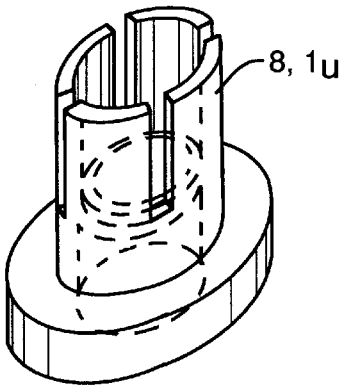
Figure 23D:
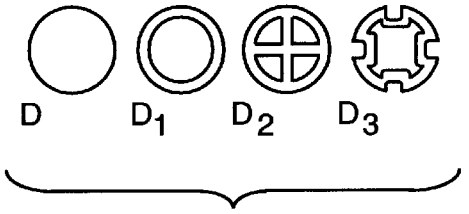
Figure 23E:
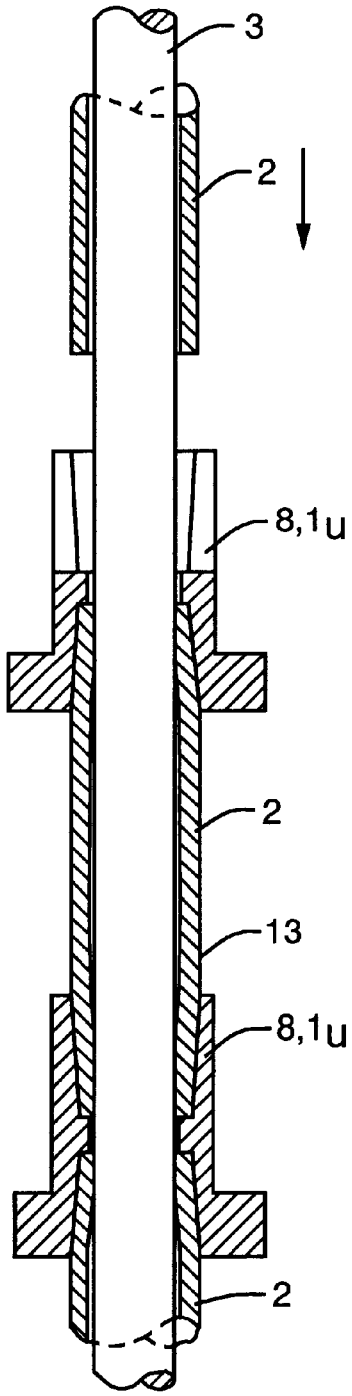
Figure 24:
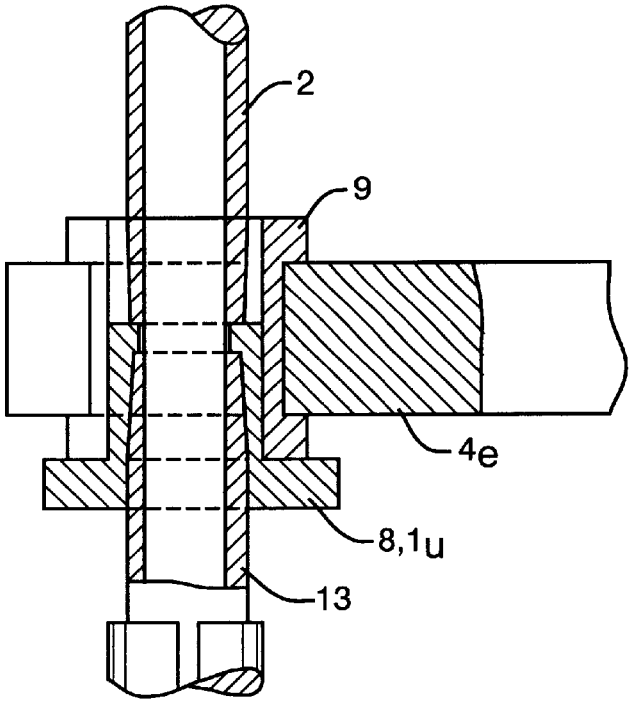
Figure 25:
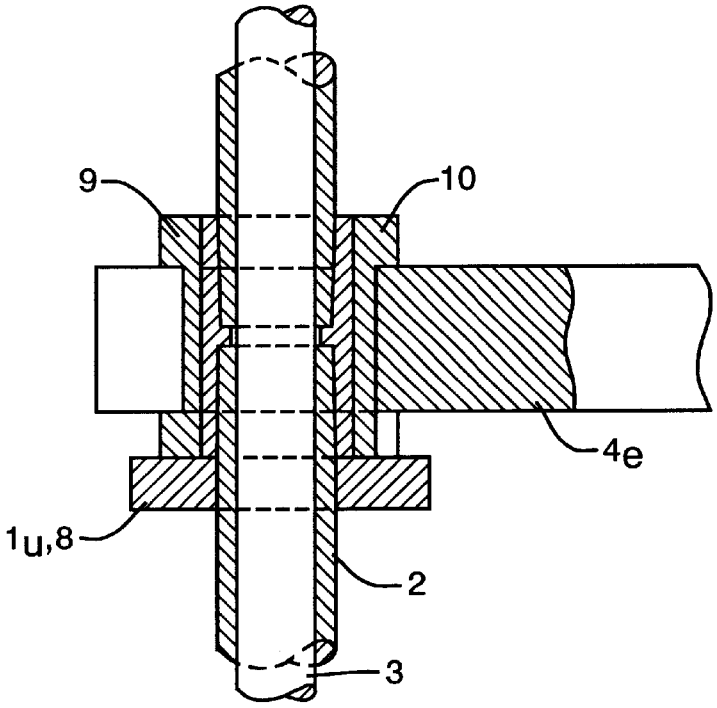
Figure 26A:
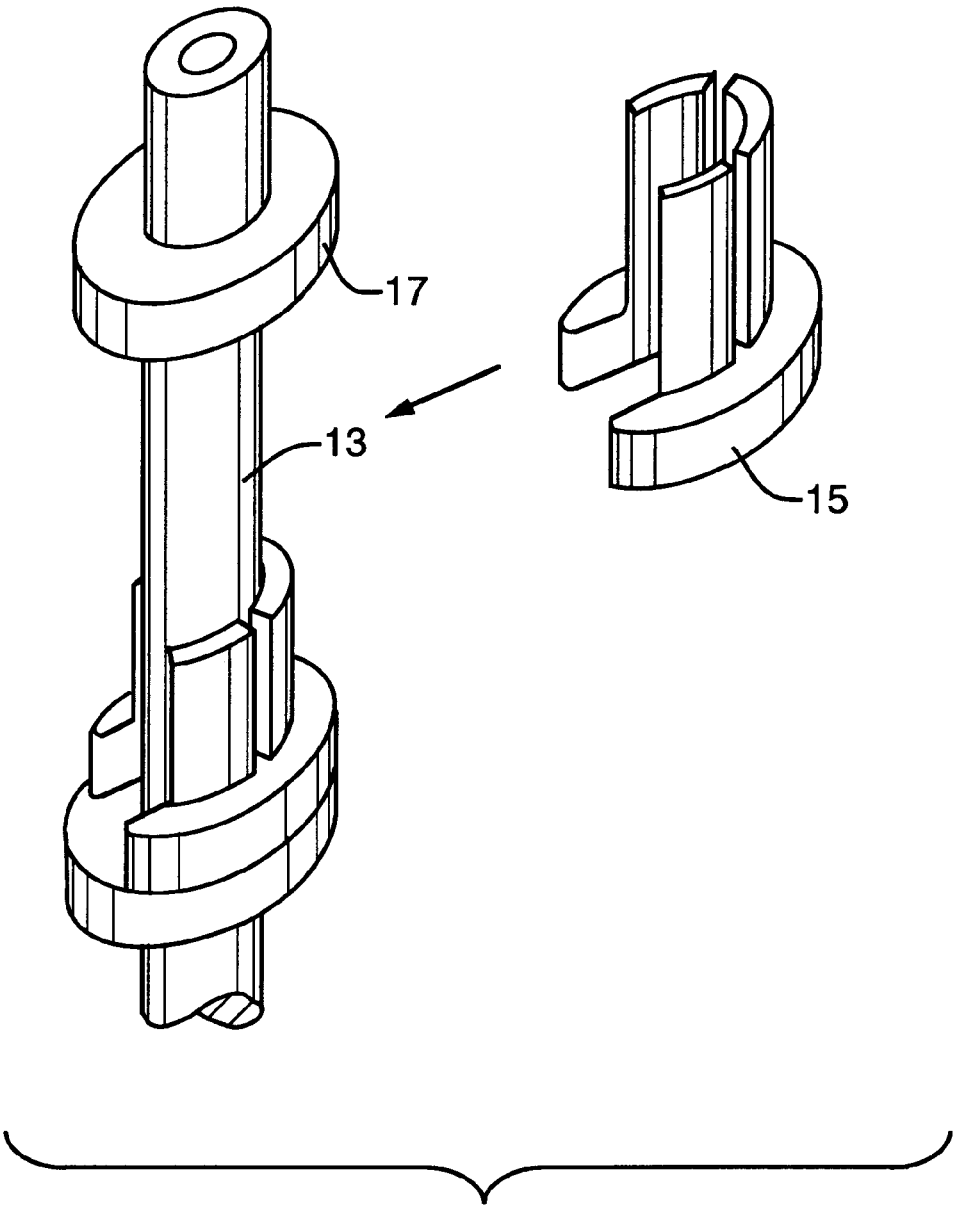
Figure 26B:
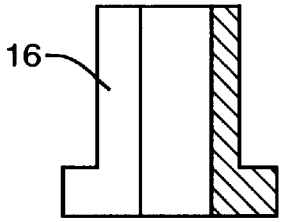
Figure 26C:
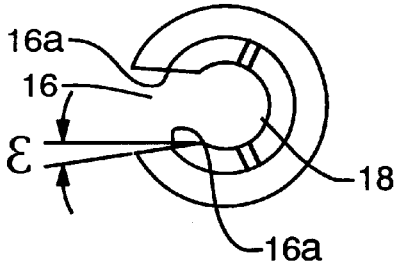
Figure 27:
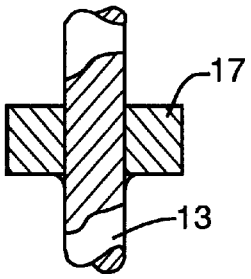
Figure 28:
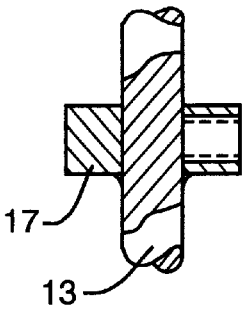
Figure 29:
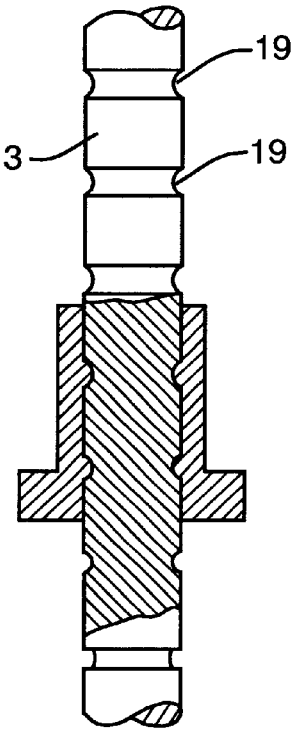
Figure 30:
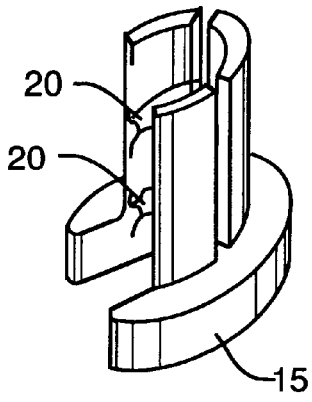
Figure 31:
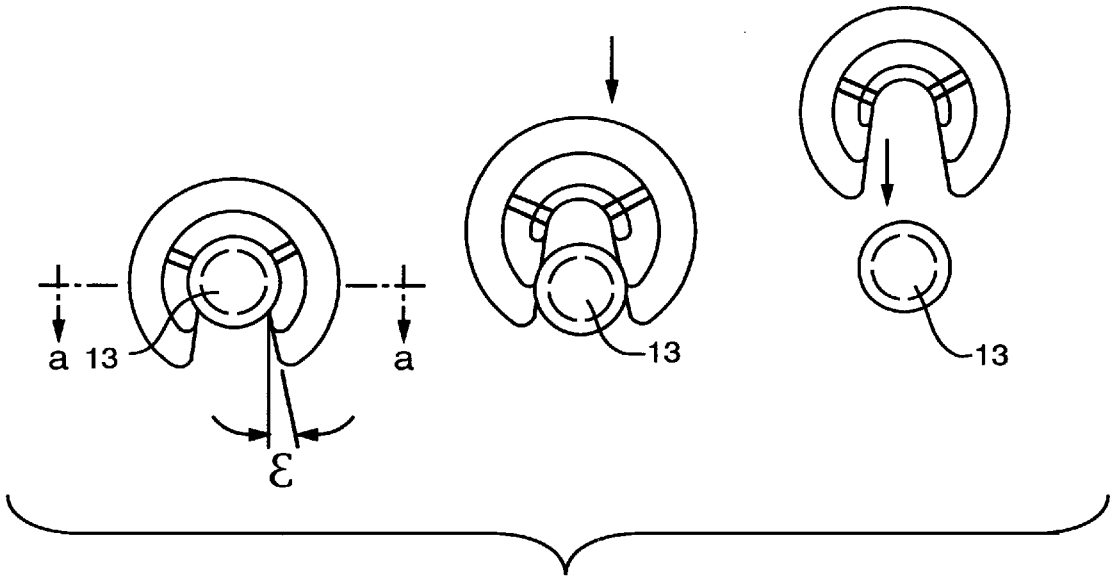
Figure 32:
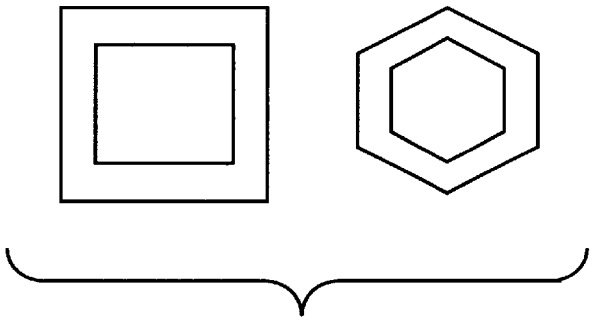

Further advantages and features of the invention are described in greater detail with reference to the following specific description:

FIG. 1 is a perspective view of a first embodiment of the constrution system according to the invention, FIG. 2 shows a detail from FIG. 1 and in particular the upper part and the lower part of a two-part connecting insert, FIG. 3 also shows a detail from FIG. 1 with the lower part of the connecting insert already pushed into place, with the inserted bar, and with the sleeve still to be pushed on to the support, FIG. 4 also shows a detail from FIG. 1 in which the connecting inserts are mounted in the finished condition in the construction members, FIG. 5 shows a side view at the left and a sectional view at the right illustrating the assembly of construction members, connecting inserts and supports which comprise bars and spacer sleeves which are pushed thereon, FIG. 6 is a view in vertical section diagrammatically explaining the formation of a clamping force when the construction system is loaded, FIG. 7 shows a further embodiment of the construction system according to the invention with distance rings for construction members (panels) of small wall thickness, FIG. 8A and 8B respectively show a perspective view and a view in section of a further embodiment of the construction system according to the invention which is particularly suitable for constructions of smaller dimensions, FIG. 9A is a view in longitudinal section of a connecting insert for the construction system shown in FIG. 8, FIG. 9*b* shows said insert with a distance ring for holding a thin panel, FIG. 9*c* shows an embodiment for holding a panel extending inclinedly relative to the support, FIG. 10 shows various possible cross-sectional dimensions of the connecting bar of the support, FIG. 11A, 11B and 11C show various possible configurations of the lower end of the spacer sleeve of a support, FIG. 12 is a perspective view of a further embodiment of the construction system according to the invention, in which, with the supports already standing, subsequent insertion and removal of construction members (panels) is possible, insofar as the panels have lateral slots and the connecting inserts or parts thereof are also provided with a lateral slot and are arranged rotatably in the construction member, FIGS. 13 through 15 show diagrammatic views illustrating the insertion of the rotary part of the connecting insert into the construction member, FIGS. 16 through 19 are diagrammatic perspective views showing the connection of a construction member provided with a rotary part, to a support on which a further part of the connecting insert is arranged, FIGS. 20A–C is a sectional view and a plan view of the rotary part, FIGS. 21A–B shows an additional part for the rotary part of FIG. 20 for peripherally closing same, in section and as a plan view, FIGS. 22A–F is a diagrammatic plan view showing the procedure involved in inserting and removing a construction member in the form of a shelf member, FIG. 23A,B is a view in section and a plan view of the part of the connecting insert shown in FIG. 23, FIG. 23C is a perspective view of said part, FIG. 23D again shows various possible cross-sections of the bars of the supports, FIG. 23E is a view in section through a special support with parts of connecting inserts fitted thereon, FIG. 24 and 25 show the connection of a construction member of panel configuration to a support as shown in FIG. 12 in a detailed vertical section, FIG. 26A–C is a perspective view a section and as a top view illustrating a part of a connecting insert which can be laterally pushed on to the support, FIGS. 27 and 28 show vertical holding rings which are fixedly mounted on the support, FIG. 29 is a view in vertical section of a further embodiment of a support and a part of a connecting insert, FIG. 30 is a perspective view of the connecting insert, FIG. 31 shows the step of pushing such a connecting insert from the side on to the support, and FIG. 32 shows various cross-sections for bars or spacer sleeves.

In the case of the embodiment illustrated in FIGS. 1 through 6, a shelf which comprises four vertical supports 13 and three horizontal construction members (shelf board members) 4 is constructed. The supports 13 comprise continuous bars 3 and spacer sleeves 2 which are pushed thereon. The shelf members 4 have cylindrical bores 5. Now, in accordance with the invention, the connection of the shelf members 4 to the supports 13 is made by way of connecting inserts 1 which preferably comprise plastic material. In the present structure illustrated by way of example the connecting inserts 1 in accordance with a preferred embodiment of the invention are of a two-part construction and comprise an upper part 1*o* and l*u*, wherein the lowermost lower part is in the form of a foot part $lu_{foot}$. That two-part construction permits a simple and stable arrangement of the connecting inserts in the construction member 4, wherein the parts 1*o* and 1*u* of the connecting inserts are fitted one into the other in the region of the bore 5 in the construction members 4. The connecting inserts 1 project beyond the construction members 4 and form a stable lateral holding guide means 1*h* for the supports 13. As FIGS. 5 and 6 in particular show, the parts 1*o* and 1*u* of the connecting inserts have taperingly shaped contact surfaces 1*b*, wherein those contact surfaces include an angle $\alpha$ with the longitudinal direction 14. The spacer sleeves 12 of the supports 13, which sleeves are preferably made from plastic material, may have elastic properties and may thus be radially compressible. In order to promote this, there may be provided a slot 2*a* as is shown in FIG. 11*a*. Additionally or alternatively the ends 2*b* of the spacer sleeves 2 may also be of a taperingly reduced configuration, more specifically through an angle $\gamma$, as is shown for example in FIG. 11*b*. With spacer sleeves 2 of that kind or with taperingly shaped receiving means 1*b* for the spacer sleeves 2 in the connecting insert 1 (inclination of the receiving means 1*b* again being the angle $\alpha$), when the system is loaded with a vertical force F caused by weight, a clamping force F or $F_R$ respectively directed transversely with respect thereto can be generated, as is shown in FIG. 6, whereby all essential parts of the construction system, namely the supports 13, the connecting inserts 1 and the construction members 4 are joined together to form a compact stable system. The greater the Loading that is applied to the construction members which in the present case are in the form of shelf members, the more all the above-mentioned parts press against each other and the greater is the level of stability of the system.

Therefore on the one hand the connecting inserts 1 are held in clamping relationship in the respective bores 5 in the construction members 4 while on the other hand there is a clamping connection between the connecting inserts and the supports 13 (by way of the spacer sleeves 2 on the bars 3). In order to make it easier for the components to be radially pressed together, the connecting inserts are provided with slots 1*a*, as is clearly visible in particular in FIG. 2.

Flange-like abutments 1*f* in the interior of the connecting inserts 1 limit the depth of insertion of the supports 13 and the spacer sleeves 12 thereof respectively.

The level of stability of the connection is also further enhanced by the connecting inserts 1 each having respective preferably flange-like abutment surfaces 1*e* which bear against the construction member 4 laterally beside the bore 5.

The construction system according to the invention is quick and easy to construct and nonetheless stable. It is simple to produce, while in principle it is possible to use any material such as for example plastic material, wood or metal. In principle also the most widely varying dimensions are possible starting from small shelf units and toys or playthings up to large industrial shelf assemblies and framework structures. It will be appreciated that the shape of the bodies is not limited to the shelves illustrated. It is also possible to use bodies of an irregular shape. When the construction members, for example the shelf members, are subjected to a loading, a flexing effect occurs which is reduced by the system according to the invention as the construction members are braced in place, which additionally enhances the level of stability. Accordingly even relatively sensitive materials such as for example glass, plexiglass or relatively thin sheets or boards of wood can be used and can be loaded with relatively high weights.

The embodiment illustrated in FIG. 7 has additional distance rings 6 in order also to be able to use relatively thin board members 4*a* without modifying the parts 1*u* and 1*o* of the connecting inserts 1.

In the embodiment of FIGS. 8, 8*a*, 9 and 9*b* the lower connecting insert 8 or 1*u* projects at the top out of the shelf member 4. The upper connecting insert part 7, 1*o* respectively comprises only a ring fitted thereon. That system is suitable for smaller systems.

FIG. 9*c* shows that, when using distance rings 6*s* which are cut off inclinedly and upper holding rings 7*s* which are cut off inclinedly, it is also possible to insert shelf members 4*s* in an inclined position.

In the case of the open system shown in FIG. 12 the construction members 4*e* have openings 11, 12 which are open towards the edge and which are preferably of a keyhole-shaped configuration. That makes it possible for the shelf members to be subsequently fitted into an existing system or removed therefrom, as will be described in greater detail hereinafter.

Figure 16:
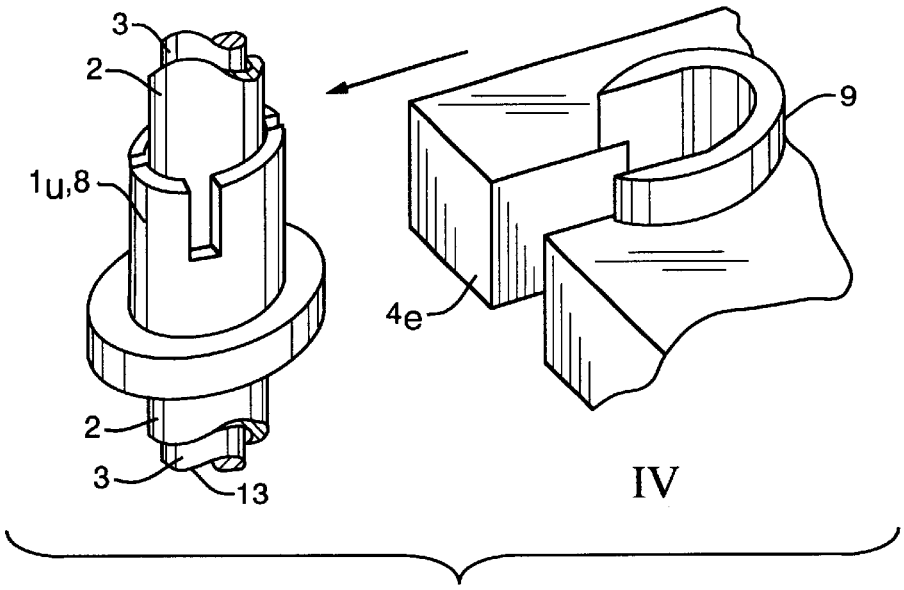
Figure 17:
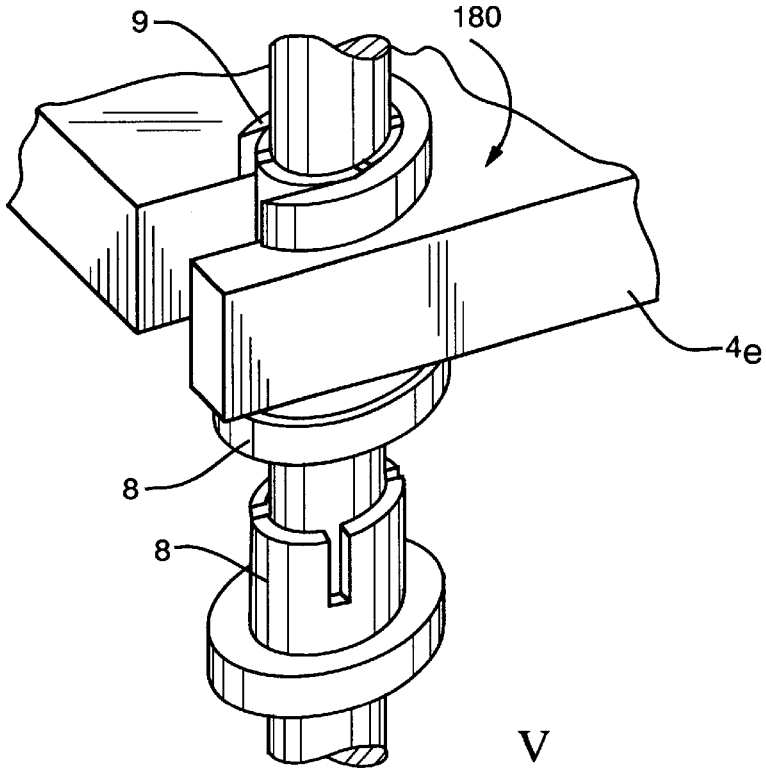

The connection of the panels 4*e* to the supports 13 is made by way of a two-part connecting insert whose first part 8*a* or 1*u* respectively is secured on the supports 13 while the second part is in the form of a rotary part 9 which is rotatable in the construction member 4*e* in order on the one hand in a first rotational position to permit the shelf member 4*e* to be fitted on to the supports 13 and on the other hand in a second rotational position of being turned through 180° to lock that connection, wherein an additional part 10 can also be inserted to complete the arrangement. FIGS. 13 through 15 show in detail the way in which the rotary part 9 can be arranged in the construction member 4*e*, with FIG. 15 showing the first rotational position in which the rotary part is ready to receive the support 13 with the lower connecting insert part 8 or 1*u* respectively disposed thereon. As shown in FIG. 16 the support 13 can be introduced into the rotary part 9 from the side, whereupon the rotary part can be turned through 180° as shown in FIG. 17. Finally, as shown in FIGS. 18 and 19, an additional part which can be of a wedge-shaped configuration with the angle can be inserted in order to achieve a stable connection between the shelf member 4*e* and the support 13. FIGS. 20 and 21 once again show in section and plan views respectively the rotary part 9 and the additional part 10 respectively.

FIG. 22 again diagrammatically shows an operating procedure involving introducing the rotary part 9 into the shelf member 4*e* and connection thereof to the support 13 by way of the lower connecting insert part 8 or 1*u* respectively. FIG. 23*a* is a view in cross-section and a plan view of that connecting insert part 8 or 1*u* respectively. FIG. 23*b* is a perspective view and FIG. 23 shows the fitting of the connecting insert part 8 or 1*u* into the support 13. FIGS. 24 and 25 are diagrammatic views in longitudinal section showing the connection of the support 13 to the shelf member 4*e* by way of the lower connecting insert part 8 or 1*u* respectively and the rotary part 9, said rotary part 9 being in the first rotational position in FIG. 24 and in the second rotational position in FIG. 25.

FIG. 26 shows an embodiment of a connecting insert part 15 provided with a lateral longitudinal opening 16 in order to be able to be pushed on to the support 13 from the side. Provided on the support at vertical spacings are holders 17 which, as shown in FIG. 27, can be for example welded on or can be screwed on as shown in FIG. 28. The walls 16*a* of the longitudinal opening 16 overall include an angle 2E with each other, which makes it easier for the insert part to be pushed on from the side. In that case the longitudinal opening 16 can be narrower in the rear region than the bore 18 for receiving the support 13. Accordingly the connecting insert part 15 must be spread open when it is pushed on to the support 13 from the side, as is shown by way of illustration in a similar example in FIG. 31. In return the connecting insert part 15 is held with a snug close fit on the support 13.

The embodiment illustrated in FIGS. 29 through 31, instead of the flanges 17, has grooves 19 in the supports 13, into which ridges 20 on the connecting insert parts 15 can engage in order to ensure a vertical holding action.

FIG. 32 shows other cross-sections for bars or spacer sleeves.

What is claimed is:

1. A construction system for building three-dimensional structures comprising supports, to which construction members are releasably secured, wherein the supports extend through bores in the construction members, and wherein there are provided connecting inserts having receiving means which are removably arranged within the bores in the construction members and by way of which the supports are removably connected to the construction members, wherein the supports comprise bars and spacer sleeves which are removably introduced thereon, wherein the bars extend through the connecting inserts and the spacer sleeves are arranged between the construction members and are supported at the connecting inserts, the receiving means of the connecting inserts for the spacer sleeves having an internal surface and an external surface, the internal surface being tapered, wherein the connecting inserts hold in clamping relationship within the bores of the construction members to which they are removably inserted and provide a clamping connection to the supports.

2. The construction system of claim 1, wherein the connecting inserts project sleeve-like beyond the construction members to which they are inserted forming a lateral holding guide means for the supports.

3. The construction system of claim 1, wherein the connecting inserts have flange-like abutments.

4. The construction system of claim 1, wherein the connecting inserts are multi-part connecting inserts having at least one upper connecting insert and at least one lower connecting insert, said multiple connecting inserts further including at least one distance ring.

5. The construction system of claim 4, wherein the lower connecting insert extends through the bore in the construction member and beyond same and the upper connecting insert is a ring removably disposed on the upper connecting insert.

6. The construction system of claim 1, wherein the connecting inserts each have a lateral longitudinal opening having walls through which a support is removably introduced.

7. The construction system of claim 6, wherein the walls of the longitudinal opening include an angle.

8. The construction system of claim 6, wherein the longitudinal opening is narrower than an inner bore which is suitable for receiving the support, wherein the walls of the longitudinal opening are urged apart to receive the support.

9. The construction system of claim 1, wherein the connecting inserts each comprise plastic material produced by an injection moulding process.

10. The construction system of claim 1, wherein the supports are vertical supports and the construction members are panels.

11. A construction system for building three-dimensional structures comprising supports, to which construction members are releasably secured, wherein the supports extend through bores in the construction members, and wherein there are provided connecting inserts having receiving means which are removably arranged within the bores in the construction members and by way of which the supports are removably connected to the construction members, wherein the supports comprise bars and spacer sleeves which are removably introduced thereon, wherein the bars extend through the connecting inserts and the spacer sleeves are arranged between the construction members and are supported at the connecting inserts, the spacer sleeves of the supports having tapered ends, wherein the connecting inserts hold in clamping relationship within the bores and provide a clamping connection to the supports.

12. The construction system of claim 11, wherein the receiving means of the connecting inserts for the spacer sleeves comprise an internal surface and an external surface, the internal surface being tapered.

13. The construction system of claim 11, wherein the connecting inserts project sleeve-like beyond the construction members to which they are inserted forming a lateral holding guide means for the supports.

14. The construction system of claim 11, wherein the connecting inserts have flange-like abutments.

15. The construction system of claim 11, wherein the connecting inserts are multi-part connecting inserts having at least one upper connecting insert and at least one lower connecting insert, said multiple connecting inserts further including at least one distance ring.

16. The construction system of claim 15, wherein the lower connecting insert extends through the bore in the construction member and beyond same and the upper connecting insert is a ring removably disposed on the upper connecting insert.

17. The construction system of claim 11, wherein the connecting inserts each have a lateral longitudinal opening having walls through which a support is removably introduced.

18. The construction system of claim 17, wherein the walls of the-longitudinal opening include an angle.

19. The construction system of claim 17, wherein the longitudinal opening is narrower than an inner bore which is suitable for receiving the support, wherein the walls of the longitudinal opening are urged apart to receive the support.

20. The construction system of claim 11, wherein the connecting inserts each comprise plastic material produced by an injection moulding process.

21. The construction system of claim 11, wherein the supports are vertical supports and the construction members are panels.

22. A construction system for building three-dimensional structures comprising supports, to which construction members are releasably secured, wherein the supports extend through openings in the construction members, and wherein there are provided connecting inserts having receiving means which are removably arranged within the openings in the construction members and by way of which the supports are removably connected to the construction members, wherein the supports comprise bars and spacer sleeves which are removably introduced thereon, wherein the bars extend through the connecting inserts and the spacer sleeves are arranged between the construction members and are supported at the connecting inserts, wherein the connecting inserts hold in clamping relationship within the openings and provide a clamping connection to the supports.

23. The construction system of claim 22, wherein the connecting inserts project sleeve-like beyond the construction members to which they are inserted forming a lateral holding guide means for the supports.

24. The construction system of claim 22, wherein the connecting inserts are multi-part connecting inserts.

25. The construction system of claim 22, wherein the connecting inserts each have a lateral longitudinal opening having walls through which a support is removably introduced.

26. The construction system of claim 25, wherein the longitudinal opening is narrower than an inner bore which is suitable for receiving the support, wherein the walls of the longitudinal opening are urged apart to receive the support.

27. The construction system of claim 22, wherein the connecting inserts each have a rotary part, the rotary part having a lateral longitudinal opening and is rotatably arranged in the opening in the construction member.

28. The construction system of claim 27, wherein an additional part is provided to close the lateral longitudinal opening in the rotary part.

29. The construction system of claim 22, wherein the connecting inserts each comprise plastic material produced by an injection moulding process.

30. The construction system of claim 22, wherein the supports are vertical supports and the construction members are panels.

* * * * *